US008384278B2

(12) United States Patent
Benz et al.

(10) Patent No.: US 8,384,278 B2
(45) Date of Patent: Feb. 26, 2013

(54) LEADLESS PACKAGE HOUSING HAVING AN INSULATOR AND COMPOSITION

(75) Inventors: Andreas Benz, Bamberg (DE); Manfred Roeckelein, Kemmern (DE); Heidrun Lange, Bamberg (DE); Jochen Fischer, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 90 days.

(21) Appl. No.: 12/938,814

(22) Filed: Nov. 3, 2010

(65) Prior Publication Data

US 2011/0121711 A1 May 26, 2011

(30) Foreign Application Priority Data

Nov. 24, 2009 (DE) ..... 10 2009 047 055

(51) Int. Cl.
*H01T 13/20* (2006.01)

(52) U.S. Cl. ..... 313/141; 313/135; 313/143; 313/144; 313/145; 313/118; 123/169 R; 123/169 EL

(58) Field of Classification Search ..... None
See application file for complete search history.

(56) References Cited

U.S. PATENT DOCUMENTS

| | | | | |
|---|---|---|---|---|
| 3,903,453 | A * | 9/1975 | Nishio | 315/58 |
| 4,506,186 | A | 3/1985 | Damson et al. | |
| 4,810,929 | A * | 3/1989 | Strumbos | 313/11.5 |
| 5,159,233 | A * | 10/1992 | Sponseller et al. | 313/141 |
| 6,111,345 | A * | 8/2000 | Shibata et al. | 313/141 |
| 6,160,342 | A | 12/2000 | Nishikawa et al. | |
| 6,310,430 | B1 * | 10/2001 | Moriya | 313/141 |
| 7,443,089 | B2 * | 10/2008 | Hoffman et al. | 313/141 |
| 2005/0110381 | A1 * | 5/2005 | Kanao | 313/141 |
| 2006/0246807 | A1 | 11/2006 | Hori | |
| 2007/0040487 | A1 * | 2/2007 | Kyuno et al. | 313/141 |
| 2007/0046162 | A1 * | 3/2007 | Moribe et al. | 313/143 |
| 2007/0290594 | A1 * | 12/2007 | Hoffman et al. | 313/142 |
| 2009/0189505 | A1 * | 7/2009 | Below | 313/143 |
| 2010/0141110 | A1 * | 6/2010 | Nakamura et al. | 313/143 |
| 2010/0264823 | A1 * | 10/2010 | Suzuki et al. | 315/71 |

FOREIGN PATENT DOCUMENTS

| | | |
|---|---|---|
| JP | 4-94078 | 3/1992 |
| JP | 9-219273 | 8/1997 |

* cited by examiner

*Primary Examiner* — Sikha Roy
(74) *Attorney, Agent, or Firm* — Kenyon & Kenyon LLP

(57) ABSTRACT

A spark plug for an internal combustion engine, having an insulator including an insulator shoulder designed for mounting a tensioning nut or a housing and having a first outer diameter, an insulator head which is situated farther from the combustion chamber and adjoins the insulator shoulder, and which has a second outer diameter which is smaller than the first outer diameter, and a continuous cavity, a composition including a first contact composition, a second contact composition, and a composition resistor situated between the first contact composition and the second contact composition, a connecting pin which contacts the first contact composition, a center electrode which contacts the second contact composition, and a ground electrode. The connecting pin, the composition, and the center electrode are situated in the cavity, and the composition resistor has a third outer diameter, and a ratio of the third outer diameter to the second outer diameter is between 0.35 and 0.7.

21 Claims, 2 Drawing Sheets

LEADLESS PACKAGE HOUSING HAVING AN INSULATOR AND COMPOSITION

RELATED APPLICATION INFORMATION

The present application claims priority to and the benefit of German patent application no. 10 2009 047 055, which was filed in Germany on Nov. 24, 2009, the disclosure of which is incorporated herein by reference.

FIELD OF THE INVENTION

The present invention relates to a spark plug for an internal combustion engine, and a spark plug system using the spark plug according to the present invention.

BACKGROUND INFORMATION

The related art discloses spark plugs having a composition resistor in the insulator for reducing the spark burn-off and for interference suppression. The temperature load caused by the ignition current and the heat of combustion may result in oxidation of the composition resistor packet, thus increasing the resistance. This increase in resistance may result in blockage of the ignition current.

SUMMARY OF THE INVENTION

The spark plug according to the present invention having the features described herein may be used in particular for stationary engines as the result of enlarging the composition resistor, thus achieving a service life of greater than 2000 hours. In addition, in the spark plug according to the present invention the insulator dielectric strength is sufficient for stationary engines when typical ignition systems are used.

These advantages are achieved using the spark plug according to the present invention for an internal combustion engine, having an insulator which includes an insulator shoulder designed for mounting a tensioning nut or a housing and having a first outer diameter, an insulator head which is situated farther from the combustion chamber and adjoins the insulator shoulder, and which has a second outer diameter which is smaller than the first outer diameter, and a continuous cavity in the insulator. The insulator head may directly adjoin the insulator shoulder on the side of the insulator shoulder situated away from the combustion chamber.

The spark plug according to the exemplary embodiments and/or exemplary methods of the present invention also includes a connecting pin, a composition, a center electrode, and a ground electrode. The composition includes a first contact composition which is contacted by the connecting pin, a second contact composition which is contacted by the center electrode, and a composition resistor situated between the first contact composition and the second contact composition. The connecting pin, the composition resistor, and the ground electrode are situated in sequence in the cavity in the insulator.

According to the exemplary embodiments and/or exemplary methods of the present invention, the composition resistor has a third outer diameter, a ratio of this third outer diameter to the second outer diameter on the insulator head being between 0.35 and 0.7. This third outer diameter of the composition resistor corresponds to an inner diameter of the cavity in the insulator at the level of the composition resistor. The spark plug according to the present invention is advantageously used in all spark-ignition engines. Stationary spark-ignition gas engines, which drive generators or compressors, for example, may particularly be used. These particular applications require spark plugs having service lives greater than 2000 hours. Due to the higher compression for gas-fired operation, higher ignition voltages and therefore higher ignition energies are necessary, which may additionally reduce the service life of the composition resistor. In the composition resistor the current is conducted along electrically conductive tracks located between nonelectrically conductive particles.

More electrically conductive tracks are available as the result of enlarging the composition resistor cross section. The electrical and thermal load on the composition resistor is reduced by enlarging the composition resistor cross section, i.e., the third diameter, thus increasing the service life of the spark plug as a whole. It is not possible to arbitrarily enlarge the overall dimensions of the spark plug, since it must be positioned in the cylinder head, and in particular for direct injection must be positioned very close to the injection unit. However, the insulation must have a certain thickness to prevent arcing of the voltage. Thus, it is desirable to enlarge the composition resistor diameter, although this decreases the insulation layer for the same outer dimensions of the overall spark plug.

According to the exemplary embodiments and/or exemplary methods of the present invention, a ratio of the third outer diameter to the second outer diameter between 0.35 and 0.7 has been found to address this conflict of interests, in particular for stationary spark-ignition gas engines. The contact composition and the composition resistor may be manufactured as follows: glass particles are coated with electrically conductive particles, may be made of carbon. Adhesive is used for better adhesion between the glass particles and the electrically conductive particles. The coated glass particles are filled into the cavity above the center electrode and may be sealed. The entire ceramic body of the spark plug together with the coated glass particles is then heated. The connecting pin is pressed into the heated compound and thus fixedly bonded to the composition. Different conductivities may be set by using different concentrations of the electrically conductive particles in the composition resistor and in the contact composition. At the same time, the solidified composition seals off the spark plug. Thus, the composition resistor represents an electrical resistor for reducing the spark burn-off and for interference suppression.

The further descriptions herein provide exemplary refinements of the present invention.

In another exemplary embodiment, the ratio of the third outer diameter to the second outer diameter is between 0.4 and 0.65, in particular between 0.45 and 0.6, in particular between 0.5 and 0.55. These values allow a sufficient composition resistor cross section while at the same time allowing a reliable insulator thickness and acceptable outer dimensions of the spark plug.

In another exemplary embodiment, it is provided that the connecting pin has a fourth outer diameter at a side which is in contact with the composition, in particular the first contact composition, a ratio of the fourth outer diameter to the third outer diameter being between 0.8 and 0.95, in particular between 0.85 and 0.9. The connecting pin is located in the cavity in the insulator, farther away from the combustion chamber than the composition resistor. This connecting pin is securely seated in the composition by pressing the connecting pin into the composition before the first contact composition solidifies. Due to the fact that the fourth outer diameter is slightly smaller than the third outer diameter, the first contact composition is able to rise up on the side of the connecting pin, and encloses the connecting pin in the solidified state.

In addition, the housing or the tensioning nut may have an outer thread, having a nominal diameter, for screwing the spark plug into the internal combustion engine, a ratio of the third outer diameter to the nominal diameter being greater than 0.3, in particular greater than one-third, in particular greater than 0.4, and in particular greater than 0.5. The enlarged composition resistor according to the present invention may particularly be used for spark plugs having an integral thread equal to or greater than 18 mm. Compared to conventional spark plugs having an integral thread of 14 mm, the third diameter is thus enlarged from approximately 4.5 mm to equal to or greater than 6 mm.

Furthermore, the third outer diameter may be equal to or greater than 6 mm, in particular equal to or greater than 6.5 mm, and in particular equal to or greater than 7 mm. The larger the cross section of the composition resistor, the more electrically conductive tracks that are available. In this way the electrical and thermal load on the composition resistor is decreased, and ultimately the service life of the spark plug is increased.

In addition, the second outer diameter may be equal to or greater than 13 mm, in particular equal to or greater than 14 mm, and in particular equal to or greater than 15 mm. For a corresponding enlargement of the third outer diameter on the composition resistor, the second outer diameter on the insulator head must also be enlarged to ensure adequate insulation.

In one advantageous embodiment it is provided that the cavity in the insulator tapers at a transition from the second contact composition to the center electrode, the taper of the transition may be designed in multiple stages and/or via a bevel and/or having a radius. The center electrode may have a slightly widened head on its side situated away from the combustion chamber, via which on the one hand it is seated in the taper in the insulator cavity, and on the other hand it protrudes into the second contact composition. This taper may be designed via multiple stages, a bevel, a radius, or a combination thereof.

It is also advantageous for the cavity to have a uniform bore diameter, also referred to as composition bore diameter, over the entire length of the connecting pin, the first contact composition, and the composition resistor up to the transition, just described, being at the taper to the center electrode. This composition bore diameter is equal to the third outer diameter. This simplifies the manufacture of the spark plug, since the cavity has a uniform diameter on its side of the transition to the center electrode situated away from the combustion chamber.

In another exemplary embodiment it is provided that the insulator head has ribs which extend the leakage current, the second outer diameter being defined as the largest outer diameter present on the insulator. These leakage current-extending ribs may be provided on the end of the insulator situated away from the combustion chamber. Thus, the second outer diameter on the insulator head is defined not by the partially reduced outer diameter between these ribs, but, rather, by the largest outer diameter present on the insulator head, which may be directly above the insulator shoulder.

Furthermore, it is advantageously provided that the connecting pin includes a portion which protrudes beyond the insulator, a terminal nut being screwed onto the protruding portion, and the terminal nut and the protruding portion being in flush abutment.

The exemplary embodiments and/or exemplary methods of the present invention also encompasses an ignition system for an internal combustion engine, including a spark plug connector and a spark plug, just described, having a flush upper closure, the spark plug connector including a spring, and the spring contacting the spark plug on the end face at the flush closure of the terminal nut and connecting pin. Electrical connecting pins are usually provided with a thread on the contact side with respect to the connector, onto which a terminal nut having a through hole and a standardized outer contour is screwed.

According to the exemplary embodiments and/or exemplary methods of the present invention, contact may be made at the end face on the terminal nut via a spring. However, the typical design according to the related art leaves an indentation open at the end face, which may result in faulty contact with the spring. The extension of the thread or the protruding portion of the connecting pin, which may be used according to the exemplary embodiments and/or exemplary methods of the present invention, results in a planar closure at the terminal nut, on which the spring may be supported. Compared to a pressed-on SAE connection, the nut has the advantage that lower push-on forces of the connector are necessary for conventional contacting on the exterior of the nut, since the friction forces, for example when a brass nut is used, are lower. Thus, the conventional contacting as well as the end-face contacting via a spring are advantageously possible.

One exemplary embodiment of the present invention is described in detail with reference to the accompanying drawings.

DETAILED DESCRIPTION

Figure 1:
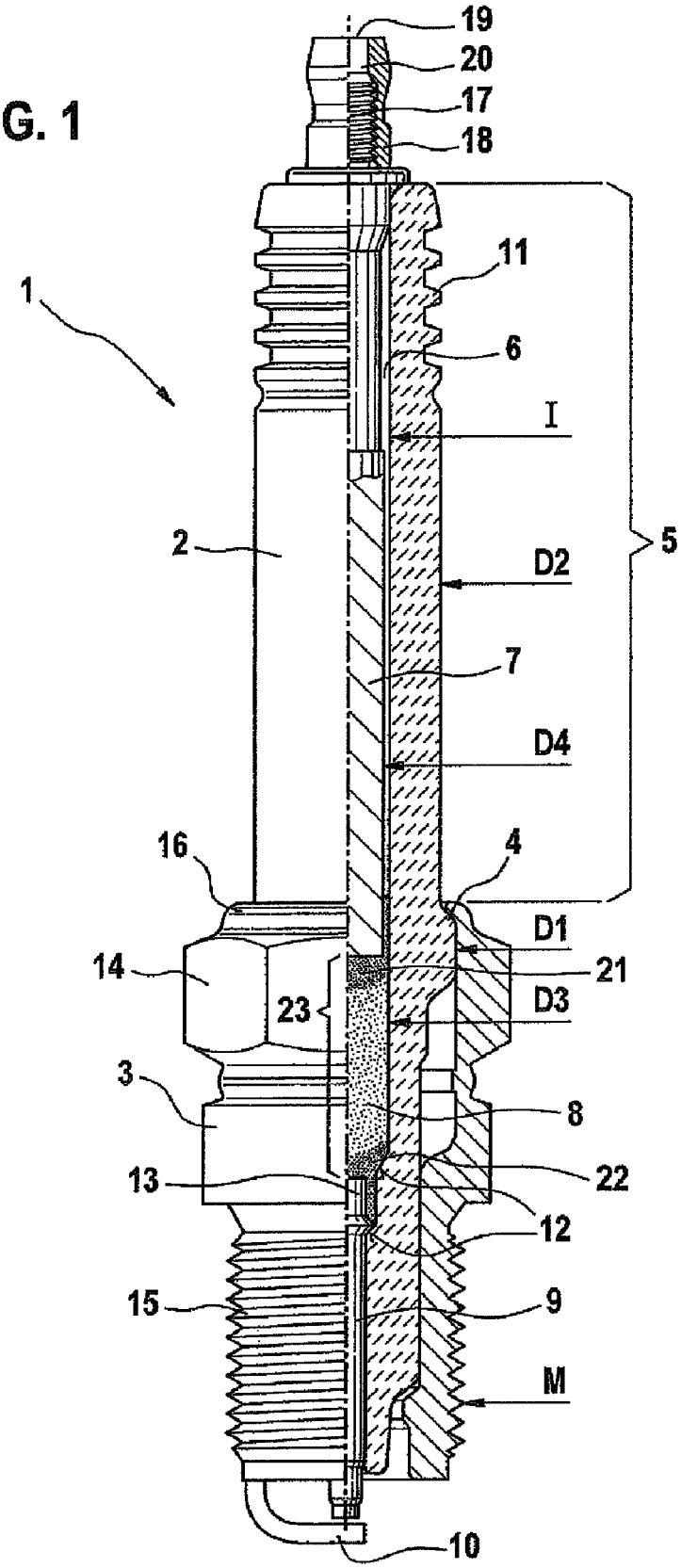
FIG. 1 shows a spark plug according to the present invention, according to one exemplary embodiment.

FIG. 1 shows a spark plug 1 according to the exemplary embodiment, having an insulator 2, a housing 3, a connecting pin 7, a composition 23, a center electrode 9, a ground electrode 10, and a terminal nut 18. Insulator 2 has a continuous cavity 6 over its entire length. Middle electrode 9, composition 23, and connecting pin 7 are located in this cavity 6 in the order stated. Terminal nut 18 is screwed onto connecting pin 7 on the outside of insulator 2. Composition 23 includes a first contact composition 21, a second contact composition 22, and a composition resistor 8 situated between first contact composition 21 and second contact composition 22.

On its exterior, on its end situated away from the combustion chamber, insulator 2 has multiple ribs 11 which extend the leakage current. After these leakage current-extending ribs 11, the insulator extends with a constant second outer diameter D2 to an insulator shoulder 4. At this insulator shoulder 4 the insulator widens to first outer diameter D1 and then tapers back to insulator shoulder 4. The entire area, from the start of insulator 2 situated away from the combustion chamber to the start of insulator shoulder 4, is referred to as insulator head 5. Cavity 6 in the insulator is cylindrical, and extends from the start of insulator 2 situated away from the combustion chamber to a multistage taper 12 having a uniform inner diameter I. At multistage taper 12, cavity 6 in the insulator provides a support for a center electrode head 13 of center electrode 9.

Composition 23 extends approximately from the middle of insulator shoulder 4 to multistage transition 12. Only second contact composition 22, but not composition resistor 8, may be present in the region of transition 12, resulting in the greatest possible spreading of the resistance value. Center electrode head 13 is located in second contact composition 22 on a side close to the combustion chamber. Connecting pin 7 is located in first contact composition 21 on a side situated away from the combustion chamber. Composition 23 may be cast into cavity 6, and its third outer diameter D3 therefore exactly matches inner diameter I of cavity 6. Contact composition 21, 22 may have a low resistance value in the mΩ range.

Connecting pin 7 has a fourth outer diameter D4 on its side close to the combustion chamber. This fourth outer diameter D4 is slightly smaller than third outer diameter D3 of composition resistor 8 or inner diameter I of cavity 6. Connecting pin 7 is thus able to immerse into first contact composition 21, and is fixedly bonded to solidified composition 23.

Housing 3 rests on the exterior of insulator 2. This housing 3 extends from a side of insulator shoulder 4 situated away from the combustion chamber to the end of insulator 2 situated close to the combustion chamber. Ground electrode 10 is mounted on housing 3 at this end of insulator 2 situated close to the combustion chamber. Housing 3 also includes a hexagon head 14, an outer thread 15 having a nominal diameter M, and a flanged collar 16. Hexagon head 14 and thread 15 are used for screwing spark plug 1 into an internal combustion engine, in particular into a cylinder head.

Flanged collar 16 is bent over via the side of insulator shoulder 4 situated away from the combustion chamber, and is thus used for fastening housing 3 to insulator 2. As an alternative to this illustrated design using housing 3, a tensioning nut may rest on insulator shoulder 4. Using this tensioning nut, spark plug 1 may be clamped or screwed into an internal combustion engine.

On the end situated away from the combustion chamber, a portion 17 of connecting pin 7 protrudes beyond insulator 2. This protruding portion 17 is provided with a thread onto which a brass terminal nut 18 is screwed. The length of protruding portion 17 is selected in such a way that this protruding portion together with terminal nut 18 forms flush closure 19. In one exemplary embodiment, a taper 20 at the outer circumference of protruding portion 17 and a corresponding taper in the inner bore of terminal nut 18 define the exact screw-in depth of terminal nut 18. Alternatively, the inner bore and the protruding portion may be designed without a taper.

Figure 2:
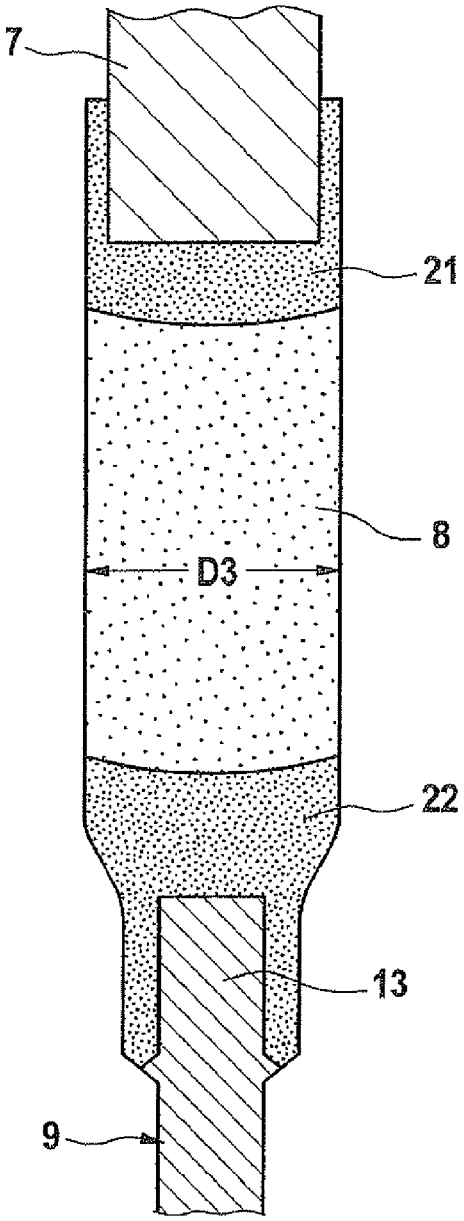
FIG. 2 shows a composition for the spark plug according to the present invention, according to the exemplary embodiment.

FIG. 2 shows composition 23 of spark plug 1 in detail according to the exemplary embodiment. It is apparent that connecting pin 7 is located in first contact composition 21, and center electrode 9 is located in second contact composition 22.

Figure 3:
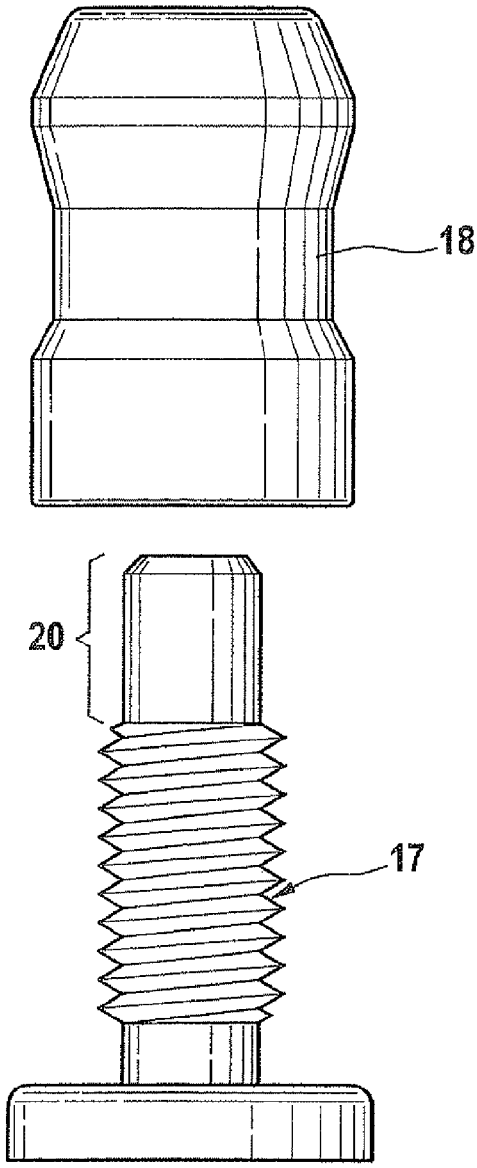
FIG. 3 shows a connecting pin together with a terminal nut of the spark plug according to the present invention, according to the exemplary embodiment.

FIG. 3 shows protruding portion 17 of connecting pin 7, and terminal nut 18 of spark plug 1, according to the exemplary embodiment in the uninstalled state.

In the exemplary embodiment, a ratio of third outer diameter D3 to second outer diameter D2 is 0.45. A ratio of fourth outer diameter D4 to third outer diameter D3 is 0.875. A ratio of third outer diameter D3 to nominal diameter M is one-third.

The design of spark plug 1 according to the exemplary embodiments and/or exemplary methods of the present invention has been shown with reference to the illustrated exemplary embodiment. Using this embodiment, it is possible in particular to achieve a cross section of composition resistor 8 by enlarging third diameter D3. At the same time, a reliable insulator layer is maintained as the result of second diameter D2. Spark plug 1 designed in this way may be used in particular for stationary spark-ignition gas engines, for example for driving generators or compressors. Service lives of greater than 2000 hours are thus achieved. By using the special embodiment of connecting pin 7 having protruding portion 17 and flush connection 19, conventional contacting at the lateral surface of terminal nut 18 as well as novel contacting via an end-face spring on flush connection 19 are possible.

What is claimed is:

1. A spark plug for an internal combustion engine, comprising:

an insulator, including an insulator shoulder configured for mounting a tensioning nut or a housing and having a first outer diameter, an insulator head which is situated farther from the combustion chamber and adjoins the insulator shoulder, and which has a second outer diameter which is smaller than the first outer diameter, and a continuous cavity;

a composition, including a first contact composition, a second contact composition, and a composition resistor situated between the first contact composition and the second contact composition;

a connecting pin which contacts the first contact composition;

a center electrode which contacts the second contact composition; and a ground electrode;

wherein the connecting pin, the composition, and the center electrode is situated in the cavity, wherein the composition resistor has a third outer diameter, and wherein a ratio of the third outer diameter to the second outer diameter is between 0.35 and 0.7, wherein the third outer diameter is equal to or greater than 6 mm.

2. The spark plug as recited in of claim 1, wherein the ratio of the third outer diameter to the second outer diameter is between 0.4 and 0.65.

3. The spark plug as recited in of claim 1, wherein the connecting pin has a fourth outer diameter at a side which is in contact with the composition, a ratio of the fourth outer diameter to the third outer diameter being between 0.8 and 0.95.

4. The spark plug as recited in of claim 1, wherein the housing or the tensioning nut has an outer thread, having a nominal diameter, for screwing the spark plug into the internal combustion engine, a ratio of the third outer diameter to the nominal diameter being greater than 0.3.

5. The spark plug as recited in of claim 1, wherein the third outer diameter is equal to or greater than 6 mm.

6. The spark plug as recited in of claim 1, wherein the second outer diameter is equal to or greater than 13 mm.

7. The spark plug as recited in of claim 1, wherein the cavity in the insulator tapers at a transition from the second contact composition to the center electrode, the taper of the transition being configured at least one of in multiple stages, via a bevel, and having a radius.

8. The spark plug of claim 7, wherein over the entire length of the connecting pin, the first contact composition, and the composition resistor up to the transition to the center electrode, the cavity has a uniform composition bore diameter which is equal to the third outer diameter.

9. The spark plug of claim 1, wherein the insulator head has ribs which extend the leakage current, the second outer diameter being defined as the largest outer diameter present on the insulator head.

10. The spark plug of claim 1, wherein the connecting pin includes a portion which protrudes beyond the insulator, a terminal nut being screwed onto the protruding portion, and the terminal nut and the protruding portion being in flush abutment.

11. An ignition system for an internal combustion engine, comprising:

a spark plug for an internal combustion engine, including: an insulator, including an insulator shoulder configured for mounting a tensioning nut or a housing and having a first outer diameter, an insulator head which is situated farther from the combustion chamber and adjoins the insulator shoulder, and which has a second outer diameter which is smaller than the first outer diameter, and a continuous cavity;

a composition, including a first contact composition, a second contact composition, and a composition resistor situated between the first contact composition and the second contact composition;

a connecting pin which contacts the first contact composition;

a center electrode which contacts the second contact composition; and a ground electrode;

wherein the connecting pin, the composition, and the center electrode is situated in the cavity, wherein the composition resistor has a third outer diameter, and wherein a ratio of the third outer diameter to the second outer diameter is between 0.35 and 0.7;

a spark plug connector having a spring, wherein the spring contacting the spark plug on the end face at the flush closure of the terminal nut and connecting pin, wherein the third outer diameter is equal to or greater than 6 mm.

12. The spark plug as recited in of claim 11, wherein the ratio of the third outer diameter to the second outer diameter is between 0.45 and 0.6.

13. The spark plug as recited in of claim 11, wherein the ratio of the third outer diameter to the second outer diameter is between 0.5 and 0.55.

14. The spark plug as recited in of claim 11, wherein the connecting pin has a fourth outer diameter at a side which is in contact with the composition, a ratio of the fourth outer diameter to the third outer diameter being between 0.85 and 0.9.

15. The spark plug as recited in of claim 11, wherein the housing or the tensioning nut has an outer thread, having a nominal diameter, for screwing the spark plug into the internal combustion engine, a ratio of the third outer diameter to the nominal diameter being greater than one-third.

16. The spark plug as recited in of claim 11, wherein the housing or the tensioning nut has an outer thread, having a nominal diameter, for screwing the spark plug into the internal combustion engine, a ratio of the third outer diameter to the nominal diameter being greater than 0.4.

17. The spark plug as recited in of claim 11, wherein the housing or the tensioning nut has an outer thread, having a nominal diameter, for screwing the spark plug into the internal combustion engine, a ratio of the third outer diameter to the nominal diameter being greater than 0.5.

18. The spark plug as recited in of claim 11, wherein the third outer diameter is equal to or greater than 6.5 mm.

19. The spark plug as recited in of claim 11, wherein the third outer diameter is equal to or greater than 7 mm.

20. The spark plug as recited in of claim 11, wherein the second outer diameter is equal to or greater than 14 mm.

21. The spark plug as recited in of claim 11, wherein the second outer diameter is equal to or greater than 15 mm.

* * * * *